United States Patent [19]

Vaice

[11] 4,012,671

[45] Mar. 15, 1977

[54] TRIGGER CIRCUIT

[75] Inventor: Peter Julian Vaice, Yorba Linda, Calif.

[73] Assignee: Gulf & Western Industries, Inc., New York, N.Y.

[22] Filed: Oct. 14, 1975

[21] Appl. No.: 621,924

[52] U.S. Cl. ..... 361/249; 102/70.2 R; 250/573

[51] Int. Cl.[2] ..... F23Q 7/02

[58] Field of Search ..... 356/134, 136; 250/573, 250/577; 9/318; 317/80; 102/70.2 R

[56] References Cited

UNITED STATES PATENTS

| | | | |
|---|---|---|---|
| 2,885,923 | 5/1959 | Simmons | 356/136 |
| 3,225,695 | 12/1965 | Kapp et al. | 317/80 |
| 3,426,942 | 2/1969 | McMains et al. | 9/318 |
| 3,437,041 | 4/1969 | Hart et al. | 102/70.2 R |
| 3,582,672 | 6/1971 | Palmer | 102/70.2 R |
| 3,636,360 | 1/1972 | Oishi et al. | 356/134 |
| 3,639,770 | 2/1972 | Zizelmann | 356/136 |
| 3,751,672 | 8/1973 | Michel et al. | 356/136 |
| 3,805,703 | 4/1974 | Cummings | 102/70.2 R |
| 3,875,863 | 4/1975 | Bymoen et al. | 102/70.2 R |
| 3,908,129 | 9/1975 | Akers | 250/577 |

*Primary Examiner*—J. V. Truhe
*Assistant Examiner*—Clifford C. Shaw
*Attorney, Agent, or Firm*—Thomas E. Harrison, Jr.; Kenneth E. Merklen

[57] ABSTRACT

An electro-optic detector utilizes a trigger circuit to sense the presense of a fluid medium and produce a control signal at a predetermined time after the fluid medium is detected.

2 Claims, 10 Drawing Figures

FIG. 1.
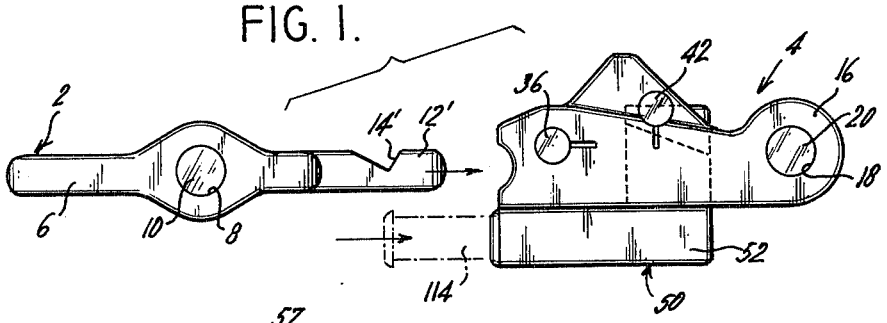
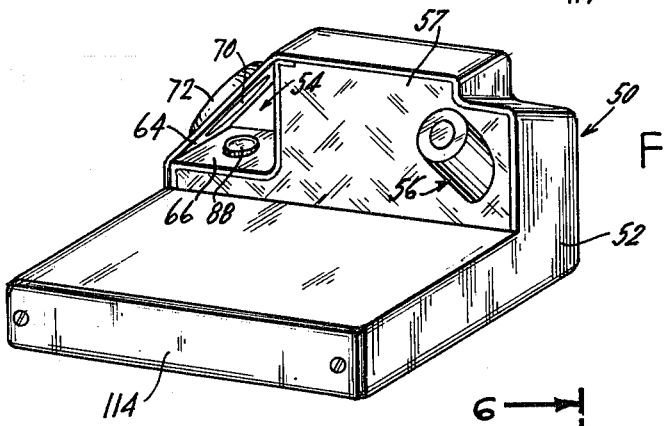
FIG. 2.
FIG. 3.
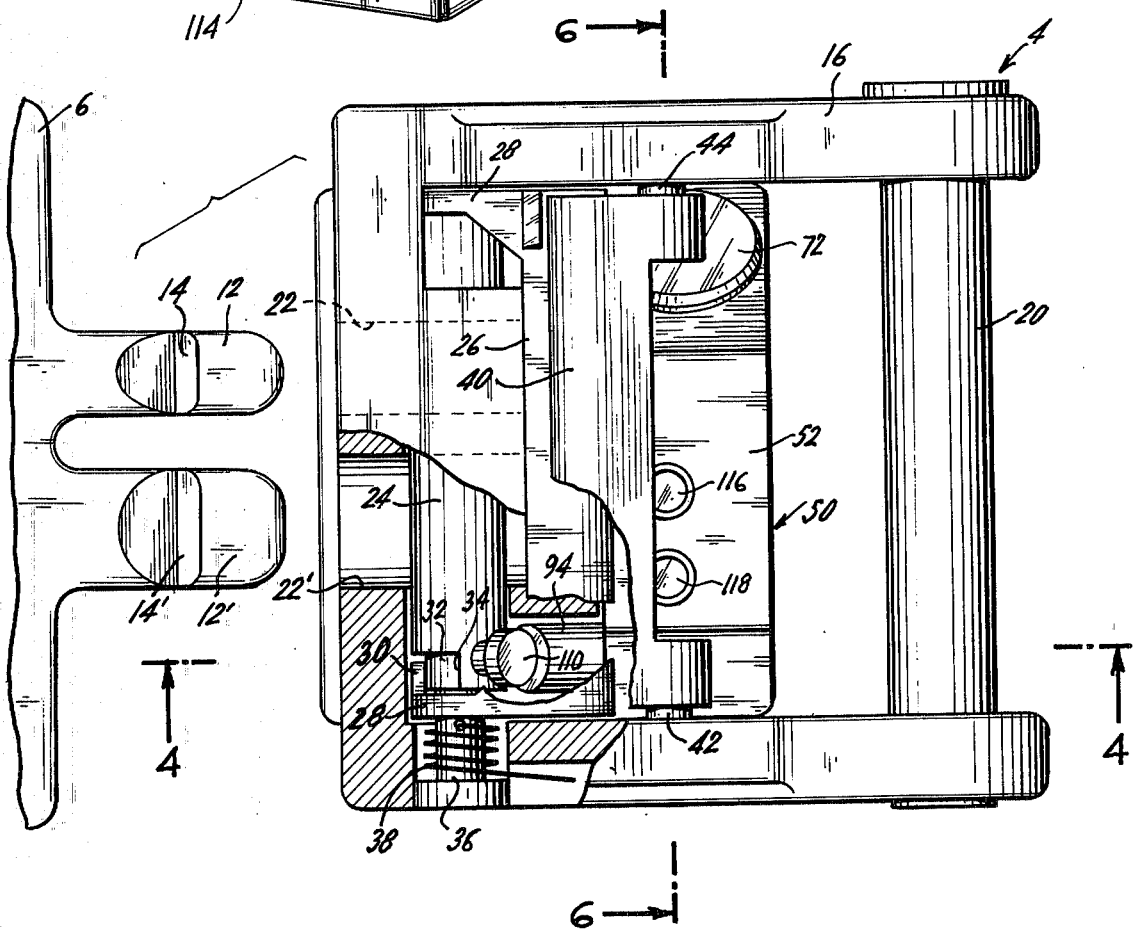

FIG. 4.
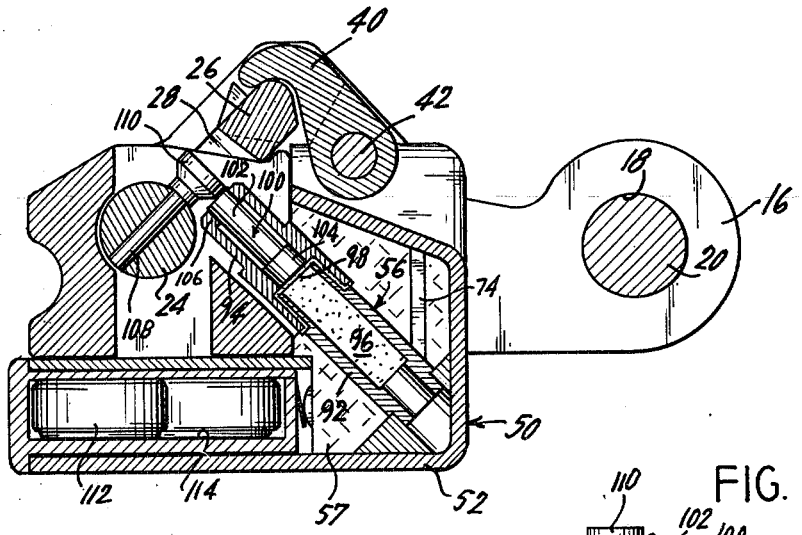
FIG. 5.
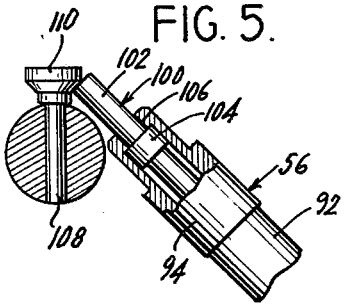
FIG. 7.
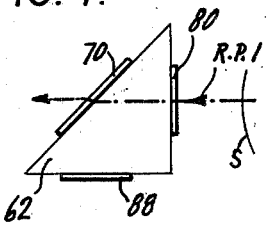
FIG. 8.
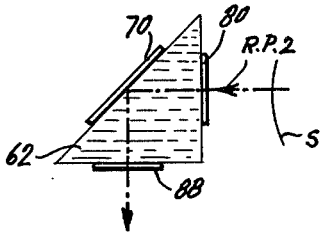
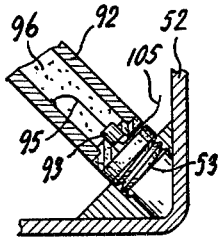
FIG. 5a.
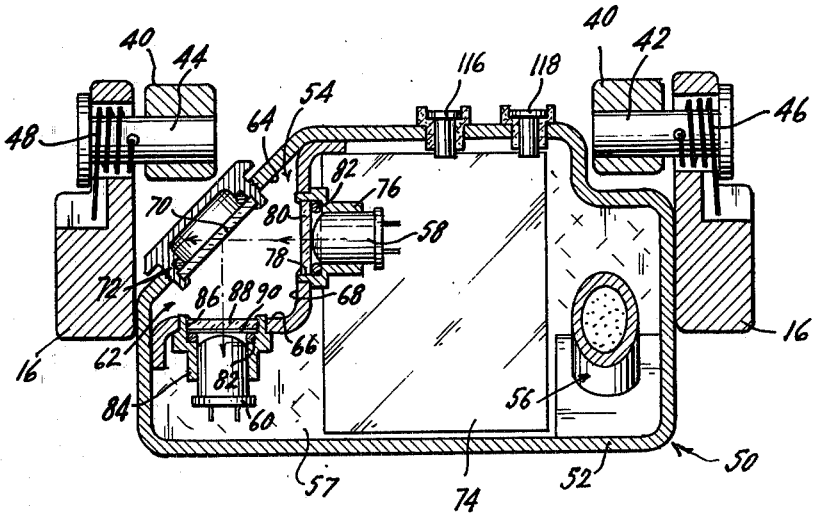
FIG. 6.

TRIGGER CIRCUIT

PRIOR ART AND OBJECTIVES

The present invention relates to an electronic trigger circuit and in particular to a trigger circuit which is automatically activated in the presence of a fluid medium.

Various types of automatic electronic trigger circuits have been proposed in the past. There still exists a need for a reliable electronic trigger circuit which can be automatically activated in the presence of a fluid medium, for example, water, and still be insensitive to false activation.

Accordingly, it is an object of the invention to overcome the problems of prior art trigger circuits and provide a reliable automatic trigger circuit which is automatically activated in the presence of a fluid medium, particularly water.

It is a still further object of the invention to provide such a trigger circuit which is relatively insensitive to false triggering.

It is another object of the invention to provide a trigger circuit for automatically activating an electronically explosive device incorporated into a canopy or harness release.

In accordance with the invention, the trigger circuit responds to the presence of a fluid medium and provides a signal to control a device external to the circuit. The circuit includes means for producing a first signal when the fluid medium is detected and means responsive to the first signal for producing a control signal. In one embodiment of the invention, the first signal producing means includes a light source positioned at one end of a light path, a light responsive means positioned at the opposite end of the light path and a hollow prism intermediate the light path. When the prism is immersed in water, light from the light source is transmitted to the light responsive means which produces the first signal. The control signal producing means includes a first time delay network which closes a first gate circuit a predetermined time after the occurrence of the first signal and a second time delay network which closes a second gate circuit a predetermined time after the operation of the first gate circuit. Closing the second gate circuit produces the control signal which is utilized in an external device. One such external device is an automatic harness release.

Although the trigger circuit of the present invention is shown in one of its practical uses, the forcible, by explosion, opening of a two piece harness connector, the present novel trigger circuit could be used in association with inflation gear on a life vest or a life raft, for example, where it is desired to have automatic actuation of an inflation system upon immersion of the inflatable device in water, for example.

Other objects and features of the invention will become apparent to those skilled in the art when taken in connection with the following description and the accompanying drawings wherein:

FIG. 1 is a side elevation view of the separated male and female strap connectors with the electro-optic actuator mounted in the female strap connecting member;

FIG. 2 is a perspective view of the electro-optic actuator;

FIG. 3 is a detailed top elevation view of the female strap connector with parts broken away and sectioned and a partial view of the male strap connecting member released from the female strap connecting member;

FIG. 4 is a sectional view taken along lines 4—4 of FIG. 3 and showing the firing assembly of the electro-optic actuator;

FIG. 5 is a detailed view of FIG. 4 showing the piston member of the electro-optic actuator extended to rotate the pin member and cross-shaft through 45° to the release position;

Figure 9:
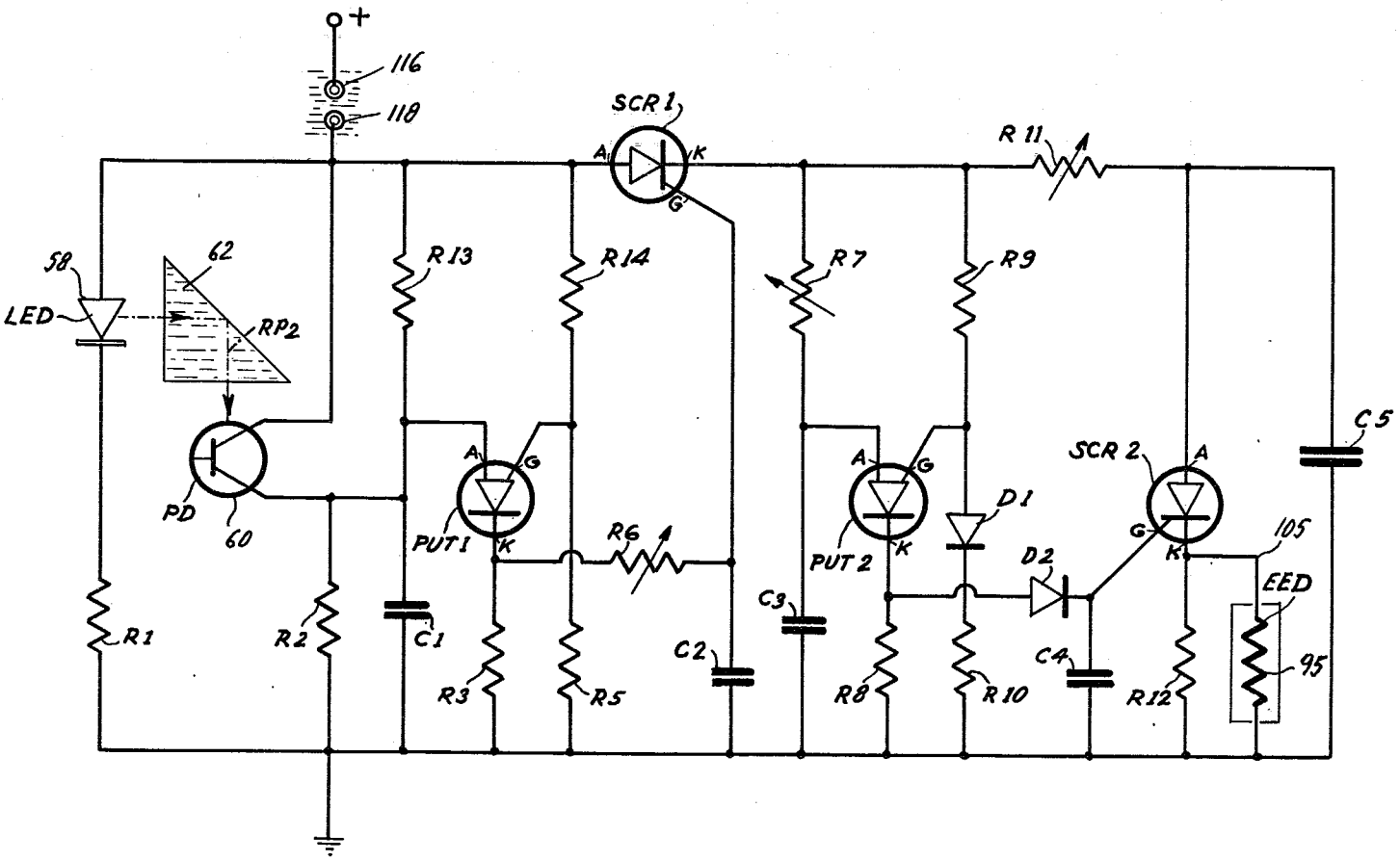

FIG. 5*a* is a sectional view of the detonation system;

FIG. 6 is a sectional view taken along lines 6—6 of FIG. 4 showing the sensing assembly of the electro-optic actuator;

FIGS. 7 and 8 are diagrammatic views of the prism and light-transmitting path included to aid in the explanation of operation of the electro-optic actuator; and FIG. 9 is an electrical schematic diagram of the circuit responsive to light for detonating the explosive in the firing assembly of the electro-optic actuator.

DESCRIPTION

Referring now to FIGS. 1–8, the harness release is a two piece component including a male strap connector 2 and a female strap connector 4. The male strap connector has a frame 6 provided with holes 8 on opposite sides thereof into which is secured a shaft 10 adapted to be engaged by a loop of a strap at one end of a harness, not shown. Extending forwardly of shaft 10 are connector prongs 12 and 12′ having recesses 14 and 14′ therein respectively. The female strap connector 4 has a frame 16 provided with holes 18 on either side thereof into which is secured shaft 20 adapted to be engaged by a loop of a strap, not shown, at the opposite end of the harness.

Frame 16 is formed with a pair of prong securing channels 22 and 22′ which receive prongs 12 and 12′ respectively of the male strap connector 2 to secure the harness. A cross-shaft 24 is journalled in frame 16 rearward of channels 22 and is positioned with a portion of the cross-shaft projecting into the channels 22 for securing the male connector by engagement with the prongs 12 in the recess 14. The cross-shaft 24 is formed with cut-away portions (not shown) aligned with the prongs securing channels 22. When the harness is secured, recesses 14 in prongs 12 of the male component 2 are engaged by shaft 24 of the female component 4 to prevent the prongs from being withdrawn from channels 22, thus securing the harness release. When shaft 24 is rotated in a counterclockwise direction, so that the cut-away portions of shaft 24 face channels 22, the shaft 24 becomes disengaged from the recesses 14 so that the prongs 12 of the male component may be withdrawn from the channels 22 and thus uncouple the male component from the female component effecting release of the harness.

The cross-shaft 24 may be manually rotated by yoke or release lever 26. The extremes of yoke lever 26 are provided with lever arms 28 having inwardly projecting teeth 30 which fit into slots 32 of the cross-shaft separated by ribs 34 in the opposite ends of cross-shaft 24. The yoke or release lever 26 and the cross-shaft 24 have a common axis, each movable rotationally about the common axis. When the yoke is displaced counterclockwise teeth 30 abut ribs 34 and rotate cross-shaft 24 also in a counter-clockwise direction effecting disengagement of the cross-shaft from the recess or detent 14, to permit release of prongs 12 from channels 22. The cross-shaft 24 and yoke lever 26 are journalled on pins 36 at opposite sides of frame 16. A coil spring 38 anchored to pin 36 and frame 16 urges the cross-shaft to turn in a clockwise direction. A locking flap 40 which locks yoke or release lever 26 in place is mounted in frame 16 by pins, 42, 44 which project through holes in opposite sides of the frame. Coil springs 46, 48, anchored to pins 42, 44 and frame 16 tend to rotate locking flap 40 in a counter-clockwise direction locking the yoke lever 26 in lock position. The overlapping of locking flap 40 over the yoke lever 26 is shown more clearly in FIG. 4.

To secure the male component to the female component, prongs 12 are inserted into channels 22. The leading portions of the prongs push against the biased or spring-loaded cross-shaft which rotates the cross-shaft against the biased direction until the cut-out portions thereof are rotationally displaced so as to permit the prongs to be fully inserted into the channels. The arrangement of teeth 30, ribs 34 and spring 38 permits rotation of cross-shaft 24 without movement of yoke lever 26. After the forward edge of recess 14 passes cross-shaft 24, spring 38 snaps cross-shaft 24 into the locking position.

To manually release the male component from the female component after engagement, locking flap 40 is rotationally displaced exposing the locking lever 26. The lever 26 is then rotated counterclockwise. In its counterclockwise travel the teeth 30 of release lever 26 engage ribs 34 on cross-shaft 24 effecting counterclockwise rotation of the cross-shaft, rotationally displacing cross-shaft 24 and the detents on the shaft thus permitting withdrawal of the prongs 12 from the channels 22. The coil springs associated with the release lever and locking flap return these members to their original positions after the forces applied to them are released.

More detail of the arrangement and operation of the harness release as thus far described can be obtained from U.S. Pat. No. 3,183,568, issued May 18, 1965 to John A. Gaylord and assigned to the same assignee as this application which is expressly incorporated by reference herein.

For automatic power activated release, the harness release is provided with an electro-optic actuator assembly 50 mounted in female strap connector 4. Actuator assembly 50 includes a housing 52 supporting a sensing assembly, generally designated by reference numeral 54 (FIG. 6), both of which are encapsulated in a potting compound 57 to provide environmental and structural support for the components.

Sensing assembly 54 includes an energy radiation or light source 58, such as a light-emitting diode (LED), for example, positioned at one end of a radiation transmission path and a radiation responsive element 60, such as a photodetector, for example, positioned at the opposite end of the controlled radiation transmission path. Intermediate the transmission path between the light source 58 and photodetector 60 is a hollow triangular prism 62, bounded by side walls 64, 66 and 68. A refractor/reflector plate 70 is mounted on wall 64 in a threaded housing 72. The threaded-screw coupling provides for movement of plate 70 with respect to wall 64 for optimum reflection of radiation to photodetector 60, when the plate 70 is functioning in the reflection mode. Thus, a finely defined wave path may be generated to guard against transient waves activating the radiation detector.

The plate 70 serves both as a reflector, when the hollow prism 62 is filled with water, and as a transparent element, when the hollow prism 62 is in an air environment, with respect to the radiated light waves generated by the light emitting diode. When functioning in the reflection mode, adjustability of the plate 70 is desirable in order to reflect as much of the energy generated by the LED to the photodetector as possible.

When functioning in the refraction mode, the plate 70 is essentially transparent to the radiated waves and, since the plate 70 is at an inclined angle with respect to the path of the radiated waves the waves strike the plate 70, refract slightly when passing through the plate and continue on a course slightly offset from the plane of the original path.

In the preferred embodiment the radiation source 58 is a light source, a light emitting diode (LED), for example, which radiates light in the infrared portion of the spectrum. The radiation responsive means 60 is a photodetector, for example, particularly responsive to infrared radiation and tuned to a particular wave length. Light from the LED 58 is filtered as by the filters 80 and/or 90 so that only a predetermined wave length of light radiated from the LED and reflected by the plate 70 along a finely defined path impinges upon the most sensitive part of the photodetector 60. Although two filters, 80 and 90 are shown in many cases it will be found that only one filter may be needed.

Light source 58 is mounted in frame 76 behind an aperture 78 in wall 68. Mounted in aperture 78 is a plate or filter 80 formed of a material which is transparent to light emitted from light source 58. An O-ring 82 seals the aperture. Similarly, photodetector 60 is mounted in frame 84 behind aperture 86 in wall 66. Mounted in aperture 86 is a plate 88 formed of a material which is transparent to light emitted from light source 58. Positioned behind plate 88 is a filter 90 which, in the preferred form, filters all light waves except for a predetermined wave length which is passed to the photodetector. Aperture 86 is sealed by O-ring 82. The sensing assembly also includes an electronic circuit which is activated by signals from the photodetector 60 which is part of the circuit. The electronic components are mounted on circuit board 74 secured in housing 52. FIG. 9 is a schematic diagram of the electronic circuit which will be described in greater detail below.

As shown in FIG. 7, when the hollow prism 62 is in an air environment the radiation path from the source S follows the path $R.P._1$, passing into the hollow body of the prism and through the plate 70. In an air environment the plate 70 is essentially transparent to the radiation generated by the source S. The plate 70 being at an inclined angle, the waves when striking the plate 70 would be refracted slightly while passing through the plate. The waves then continue slightly offset from the plane of the original path.

When the hollow body of the prism is filled with water the radiation path, as seen in FIG. 8, follows the path $R.P._2$. Radiation generated at source S passes through the plate 80 into the water environment, the radiant waves being refracted so that by refraction and reflection, via the prism 62 and plate 70, respectively the waves are directed to and through the plate 88.

In operation, when the electro-optic actuator is in an air environment, (see FIG. 7) light from light source 58 is transmitted through plate 70 and does not reach photodetector 60. When the actuator is immersed in water, (see FIG. 8) the water fills prism form 62 and light is refracted by the prism and reflected from plate 70 to photodetector 60. The photodetector 60, being responsive to radiation of the wave length generated by the radiation generating source 58 produces a signal in response thereto which is processed in the electronic circuit and utilized in a manner to be described below effecting release of the two-piece harness assembly. Essentially the electro-optic actuator serves as a switch which is open when in an air environment and closed when the prism form 62 is filled with water.

The firing assembly consists of an electrically explosive device (EED), normally referred to as a "Squib", installed in a captive mount which forms a coaxial connector to the squib to transfer an electric pulse to an internal bridge wire of the EED. The EED includes a case or housing, a piston, a plunger, an explosive charge, a coaxial center connector and a bridge wire connected to the case and the coaxial center connector. The high energy electric pulse generated in the electronic circuit is applied to the internal bridge wire via the coaxial center connector, the bridge wire being connected between the coaxial center connector (which is insulated from the case) and the case, which serves as a connection to the ground side of the circuit. The electric pulse, when applied to the bridge wire, causes the bridge wire to heat resulting in detonation of the explosive charge. When the explosive charge is detonated the piston moves in an axial direction causing the plunger to travel until the piston engages the shoulder of the housing.

The firing assembly 56 may be a squib assembly which is an integrated piston, plunger and explosive device which is inserted into the firing chamber or may be separate parts. The firing assembly is represented as including two concentric housings 92, 94 held in housing 52 by threaded plug 53. The housing 92 contains an explosive charge, 96 which is detonated by an electrical signal from the electronic circuit shown in FIG. 9. A membrane 98 is a dielectric separator between the two housings 92 and 94. Slidably mounted in housing 94 is a piston 100 having a plunger 102 and a lower outwardly extending flange 104 which is engaged by shoulder 106 when the piston is in its extended position (FIG. 5). A pin 108 is secured to cross-shaft 24 and extends upward through an opening in the frame 16 adjacent lever arm 28. The pin has a head 110 which is positioned to be engaged by the upper surface of piston 100.

Detonation of the explosive charge 96 produces an expansion of gases which forces piston 100 upward contacting the tapered neck of head 110. Extension of the piston 100 drives the head 110 and pin 108 arcuately thereby producing a corresponding rotation of cross-shaft 24 (FIG. 5) without movement of yoke lever 26. Rotation of cross-shaft 24 by the travel of piston 100 and consequent displacement of head 110 and shaft 108 aligns the cut-out portions of the cross-shaft 24 with channels 22 releasing the prongs 12 of the harness.

The firing assembly is inserted into the housing 52 by insertion into the firing chamber. A threaded plug 53 is provided to close the firing chamber and secure the firing assembly. After the EED has been fired the plug 53 may be removed and the spent charge, or the entire squib, may be removed and a new charge, or a new squib, may be inserted into the firing chamber. In the preferred arrangement the firing assembly, including the case, the piston, the plunger, the explosive charge and the detonation means is provided as an integrated unit (here referred to as a squib) which is inserted into the firing chamber and secured by the threaded plug 53. It may, however, be preferred to separate the firing assembly into its individual parts so that the piston and plunger will be reusable and the explosive charge need only be replaced after firing. Replacement of the spent charge or the spent squib makes the automatic release assembly reusable without replacement.

Electrical power for the electro-optic assembly is provided by batteries 112 held in battery compartment 114 which is slidably secured in the electro-optic assembly by screws or other suitable means. As a further safety feature and to prevent unintended opening of the harness, electrical power for the electronic circuit board 74, light source 58 and photodetector 60 is established through arming sensor 116 coupled to a source of voltage and arming sensor 118 coupled to the electronic circuit, light source and photodetector. Immersion of the assembly in water establishes a conducting path between the sensors completing the electrical circuit.

Although the preferred embodiment is illustrated as being battery operated it will be understood that a chargeable power-pack may be used to provide electric power. A power pack may require terminals which may connect into an exterior electrical system. The power pack could be pre-charged or if the harness release were to be used in an aircraft, the power pack could be coupled to the electrical system of the aircraft. A quick-release electric coupling could be used so that separation from the master electric system will be rapid.

Referring now to FIG. 9, there is shown a schematic diagram of an electronic trigger circuit specifically arranged to respond to the incidence of light on the photosensitive device and produce an electrical control signal to detonate explosive charge 96. In FIG. 9, the light source 58 is represented as a light-emitting diode also referred to by the reference LED; the photodetector 60 is represented by a phototransistor designated PD; and the electrically explosive device is designated EED.

As shown in FIG. 9, LED 58 and resistor $R_1$ are connected in series between arming sensor 118 and ground. Positive potential is applied to the circuit through arming sensor 116 and fluid coupling between sensors 116 and 118. A phototransistor, PD, having an electrical property which varies in response to the incidence of the radiation thereon, as is well known in the art, is provided. One terminal of the phototransistor PD is coupled to the positive terminal of the voltage supply and the other terminal is coupled through resistor $R_2$ to ground; resistor $R_2$ and phototransistor PD forming a voltage divider network. The junction of phototransistor PD and resistor $R_2$ is coupled to the anode A of programmable unijunction transistor, $PUT_1$ and the junction of resistor $R_{13}$ and capacitor $C_1$. The gate, G of transistor $PUT_1$ is coupled to the junction of voltage divider $R_5$ and $R_{14}$ and the cathode K of transistor $PUT_1$ is coupled to ground through a resistor $R_3$. The cathode of transistor $PUT_1$ is also coupled to a timing network consisting of variable resistor $R_6$ and capacitor $C_2$ which controls the operation of a switching gate such as silicon controlled rectifier $SCR_1$. Specifically, the gate G of $SCR_1$ is coupled to the junction of $R_6$ and $C_2$. Resistor $R_7$ and capacitor $C_3$ form a second timing network which is coupled between the output of the silicon controlled rectifier $SCR_1$ and ground. The anode A of a second programmable unijunction transistor, $PUT_2$ is coupled to the junction of resistor $R_7$ and capacitor $C_3$. The gate G of the second unijunctional transistor $PUT_2$ is coupled to the junction of resistor $R_9$ and the anode of diode $D_1$. The other terminal of resistor $R_9$ is coupled to the cathode K of silicon controlled rectifier $SCR_1$. The cathode K of the silicon controlled rectifier $SCR_1$ is also coupled to a third timing network consisting of variable resistor $R_{11}$ and capacitor $C_5$. Resistor $R_{10}$ is coupled between the cathode of diode $D_1$ and ground. The cathode K of transistor $PUT_2$ is coupled through resistor $R_8$ to ground and to the anode of diode $D_2$. The cathode of diode $D_2$ is coupled to the gate circuit of a second selectively energizable switch such as $SCR_2$. The anode A of $SCR_2$ is coupled to the junction of resistor $R_{11}$ and capacitor $C_5$. The cathode K of $SCR_2$ is coupled to the electrically explosive device EED which is detonated upon the application of electrical power. Resistor $R_{12}$ is coupled across the EED and capacitor $C_4$ is coupled between the gate of $SCR_2$ and ground.

In operation, when the trigger circuit is immersed in water, electrical power is applied to the circuit through sensors 116, 118 and light is transmitted from the LED, through the water filled prism 62 to the phototransistor PD. Light produces a change in the electrical resistance of phototransistor PD which produces an increased current flow therethrough, raising the voltage at the anode A of transistor $PUT_1$. When the voltage at the anode of transistor $PUT_1$ reaches a predetermined threshold level, the transistor switches to an ON state and current flows through the transistor raising the voltage across resistor $R_3$. This voltage increase is transferred through timing network $R_6$ and $C_2$ to the gate G of silicon controlled rectifier $SCR_1$. After a first predetermined time interval established by the timing network $R_6$, $C_2$, the silicon controlled rectifier $SCR_1$ is switched to its conducting state thereby energizing stage two of the cascaded, time controlled trigger circuit. Current flows through two networks, the first, consisting of surge resistor $R_{11}$ and $C_5$ and the second consisting of $R_7$ and $C_3$. During the time interval established by the $R_7$, $C_3$ network the capacitor $C_5$ is charged through $R_{11}$. Essentially the second network $R_{11}$, $C_5$ of the second stage serves to charge the capacitor $C_5$ for firing the electrically explosive device EED. After a predetermined time interval established by $R_7$ and $C_3$ the threshold voltage for the transistor $PUT_2$ is reached and current flows through that transistor to the gate G of $SCR_2$. When $SCR_2$ switches to a conducting state, the charge built up and stored in capacitor $C_5$ flows through $SCR_2$ to the EED causing the detonation wire 95 of the EED to heat up and detonate the device. The EED piston ruptures membrane 98 and forces piston 100 upward effecting release of the harness. The resistors $R_6$, $R_7$ and $R_{11}$ are shown as adjustable to indicate that the timing may be adjusted.

FIG. *5a* illustrates one form of detonation system using a detonation wire. The base 93 of case 92 is electrically insulated from the case and detonation wire 95 is connected between the base 93 and the case 92, the case 92 being connected to the electrical ground. Lead 105, also shown in FIG. 9, connects to the electronic trigger circuit on the printed circuit board 74. The plug 53 has an insulation pad which holds the lead 105 connected to the base 93.

The prism member of the present embodiment is shown as a hollow bodied prism which, when filled with air, is substantially void of prismatic functions with respect to the radiation generated by the radiation source. Thus, creating a first path for the generated radiant waves. When the hollow body of the prism is filled with water the prismatic functions, as respects the radiation generated by the radiation source, are expressed by reflection of the waves so that a second path for the generated radiant waves is created.

In the alternative, a solid body prism could be used in which the prismatic functions of the solid body prism, as respects the radiation, are expressed by reflection of the waves when the solid body prism is in an air environment. When the solid body prism is in a liquid environment, such as water, the prismatic functions would substantially cease, thus generating two paths for the radiated waves, depending upon what environment the prism is located. In the case of a solid body prism either the radiation source or the radiation detection and response means would be repositioned, as compared to the illustrated positions.

Although the preferred embodiment provides for a wire arrangement for detonating the explosive charge of the firing assembly an alternate arrangement may include a detonation cap which may be electrically detonated. The detonation cap could be held in place by the threaded plug, holding the cap securely against or in the base of the explosive charge. An insulated lead in the thread plug may be connected to the circuit carrying the electric pulse, such lead making contact with an insulated terminal in the cap, the case of the cap being connected to ground.

The EED may include a case which includes a cylindrical body, such as section 92 of the illustrated firing assembly. The base of the case may be insulated from the cylindrical body and the detonation wire may be connected between the insulated base and the cylindrical body, passing through, or in intimate contact with the explosive charge. Electric contact with the base of the case is made so that the electric charge from the electronic trigger circuit may be applied to the detonation wire through the insulated base of the case of the EED. The cylindrical body of the case serves as a connection to electrical ground of the electronic trigger circuit.

Although the present trigger circuit has been shown and described in association with its use in a two-piece harness securing a release assembly and other uses, such as in association with life vests and life rafts for controlling inflation systems have been mentioned, the present trigger circuit could have many other uses, such as automatic control of water levels, for example.

A preferred embodiment of the invention has been illustrated and described and several alternate arrangements have been described along with several different uses to which the invention can be placed. Other alternate construction including changes, modification and substitution of parts may be made, as will be obvious to those skilled in the art without departing from the spirit of the invention.

What is claimed is:

1. A trigger circuit for generating an electric charge for exploding an explosive device, said trigger circuit comprising;

radiation generating means for generating waves of radiation and for directing said waves in a first path, radiation responsive means, off-set from said first path, coupled for receiving said waves along a second path, off-set from said first path, said radiation responsive means having electrical characteristics which change from a first condition to a second condition in response to reception of said waves, prism means positioned in said first path and having first reflection characteristics when in an air environment and having second reflection characteristics when in a liquid environment, said second reflection characteristics for converting said first path into said second path with respect to said generated waves, a first timing circuit coupled to said radiation responsive means and driven by said radiation responsive means, for timing a first time interval, said first timing circuit including a first RC network, first normally closed gate means coupled to and controlled by said first RC network for opening said first gate means upon said first timing circuit completing timing of said first time interval, said first gate means coupled to a second RC network for forming a second timing circuit for timing a second time interval, and coupled to a third RC network for generating and storing an electric firing charge during timing of said second time interval, second normally closed gate means coupled to and controlled by said second RC network for opening said second gate means upon said second timing circuit completing timing of said second time interval, and said third RC network coupled to said second normally closed gate means, said second gate means for controlling application of said generated electric firing charge to said explosive device upon opening of said second gate means upon said second timing circuit completing timing of said second time interval.

2. A trigger circuit for generating an electric charge for exploding an explosive device as in claim 1 and further including;

a source of electric energy, said radiation responsive means coupled to said electric energy for applying said electric energy to said first timing circuit when said radiation responsive means is in said second condition.

* * * * *